United States Patent [19]

Gusman

[11] 3,999,561

[45] Dec. 28, 1976

[54] HAIR SHAMPOO AID

[76] Inventor: Leone J. Gusman, 633 N. Melrose St., Chicago, Ill. 60657

[22] Filed: May 14, 1975

[21] Appl. No.: 576,076

[52] U.S. Cl. ..... 132/9

[51] Int. Cl.[2] ..... A45D 4/18

[58] Field of Search ..... 132/9; 4/159

[56] References Cited

UNITED STATES PATENTS

| | | | |
|---|---|---|---|
| 416,489 | 12/1889 | Parrish | 132/9 |
| 1,806,155 | 5/1931 | Farrelly | 132/9 |
| 2,684,072 | 7/1954 | Lewis | 132/9 |

*Primary Examiner*—G. E. McNeill

*Attorney, Agent, or Firm*—Bernard L. Kleinke

[57] ABSTRACT

An aid for facilitating the shampooing of hair includes an elongated sheet of filmy thin flexible light-weight water-resistant material attached to a frame to form a trough-like guide, a brace adapted to engage the back of the wearer for supporting the aid from below, and an attaching device in the form of tie straps for securing the front portion of the aid to the neck of the wearer. In use, the aid extends backwardly from the wearer to guide shampoo rinse water or the like falling from the hair of the wearer to a convenient receptacle.

9 Claims, 5 Drawing Figures

HAIR SHAMPOO AID

The present invention relates to a hair shampoo aid, and it more particularly relates to an aid for facilitating the shampooing of hair by guiding the shampoo rinse water or the like falling from the hair being shampooed to a convenient receptacle.

In the past, hair shampooing aids have been employed to facilitate the convenient disposing of the shampoo rinse water. In this regard, rigid plastic trays were secured to a sink or the like to help guide the rinse water flowing under the force of gravity from the hair into the drain of the sink. While such a device may be satisfactory for some applications, it would be highly desirable to have a hair shampoo aid which could be employed where a sink or other drain is not accessible or may not be used in the shampooing of the hair. For example, a chronically ill person confined to a bed may not find it convenient to dispose of the shampoo rinse water, since such a person would find it difficult to move or be moved to a sink or the like. Therefore, it would be highly desirable to have a hair shampoo aid which may be used in a portable manner without the need for a sink or other drain for the rinse water. Such a hair shampoo aid should be adapted to be used in a bed, such as a hospital bed.

Therefore, the principal object of the pesent invention is to provide a new and improved hair shampoo aid, which facilitates the convenient disposing of rinse water, and which may be used in any convenient location including a bed.

Briefly, the above and further objects of the present invention may be realized by providing an elongated sheet of filmy thin flexible light-weight water-resistant material attached to a frame to form a trough-like guide, a brace adapted to engage the back of the wearer for supporting the aid from below, and attaching means in the form of tie straps for securing the front portion of the aid to the neck of the wearer so that the aid can extend backwardly from and be supported entirely by the wearer.

The invention, both as to its organization and method of operation, together with further objects and advantages thereof, will best be understood by reference to the following detailed description taken in connection with the accompanying sheet of drawins, wherein.

Figure 1:
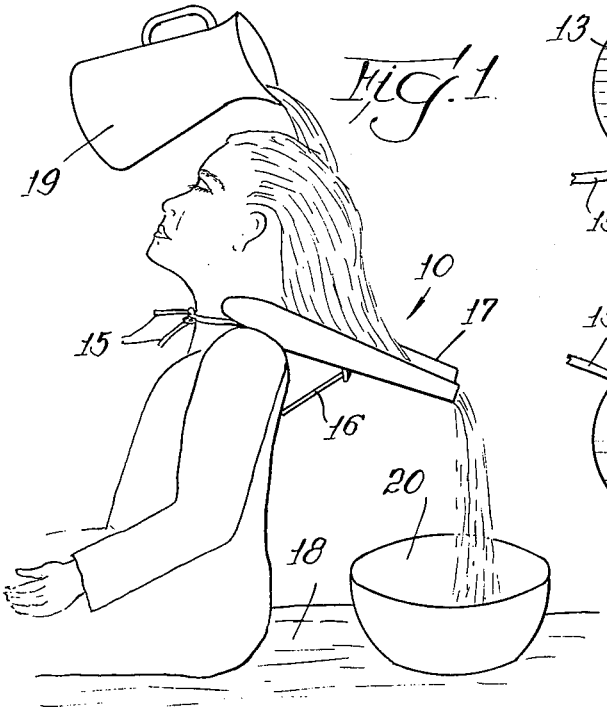
FIG. 1 is a pictorial view of the hair shampoo aid, illustrating an example of its use.

Referring now to the drawings, and more particularly to FIG. 1 thereof, there is shown a hair shampoo aid 10, which is constructed in accordance with the present invention, and which is adapted to be worn by the user to facilitate in a convenient manner the disposing of te shampoo rinse water. The shampoo aid 10 includes a neck cut-out portion 12 for engaging the neck of the user as indicated in FIG. 1, a pair of rounded tab portions 13 and 14 (FIG. 2) on opposite sides of the cut-out portion 12 engage the shoulder area of the wearer. A pair of tie straps 15 extend from the tab portions 13 and 14 at the front portion of the aid 10 so that they may be tied together to secure the aid to the neck of the wearer. A body brace 16 extends from the underside of a trough-like body portion 17 to engage the back of the wearer to support the body portion 17 from below, whereby the aid 10 as shown in FIG. 1 extends backwardly from the neck portion of the wearer to support a portion of the hair of the wearer and to guide rinse water falling from the hair for convenient disposing purposes. In use, as shown in FIG. 1, the wearer may, for example, be seated or otherwise propped up in a hospital bed 18. The neck cut-out portion 12 is first aligned with the neck of the wearer so that the neck cut-out portion 12 receives the neck of the wearer with the rounded tab portions 13 and 14 engaging the shoulder area of the wearer. The tie straps 15 are then tied in the front of the wearer to secure them and the front portion of the aid 10 about the neck of the wearer. In so doing, the body brace 16 extends at an angle from the underside of the aid 10 to engage the back portion of the wearer to support the trough-like body portion 17 in a slightly downwardly extending position immediately below the hair of the wearer. A pitcher 19 of water is used to pour water onto the hair of the wearer after shampoo is applied thereto to rinse the hair. A bowl 20 or similar container is placed on the bed 18 to the rear of the wearer opposite the rear end portion of the body portion 17 of the aid 10 so that water flowing from the pitcher 19 through the hair of the wearer is guided by the body portion 17 and off of the rear end thereof and into the bowl 20. The bowl 20 may later be emptied in a convenient manner.

Considering now the aid 10 in greater detail with reference to FIGS. 2, 3, 4, and 5 of the drawings, the aid 10 includes a wire frame generally indicated at 22 on the underside of an elongated sheet 24 of filmy thin flexible light-weight water-resistant material stretched over the frame 22. The sheet 24 may be composed of any light-weight suitable plastic sheet material which may be heat sealed.

Figure 2:
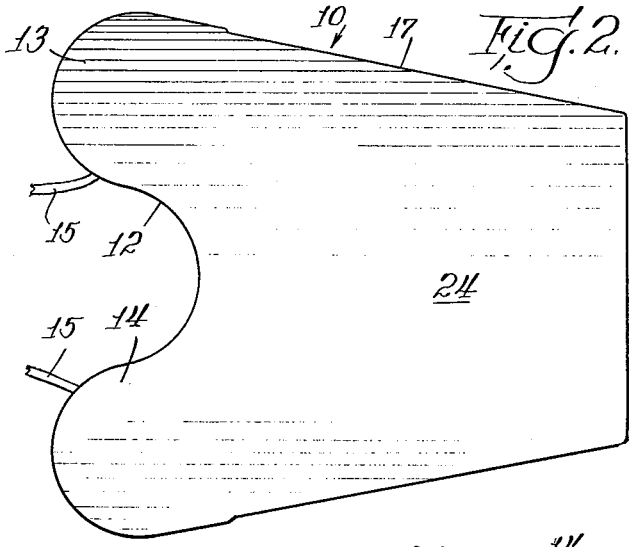
FIG. 2 is an enlarged top plan view of the aid of FIG. 1.
Figure 5:
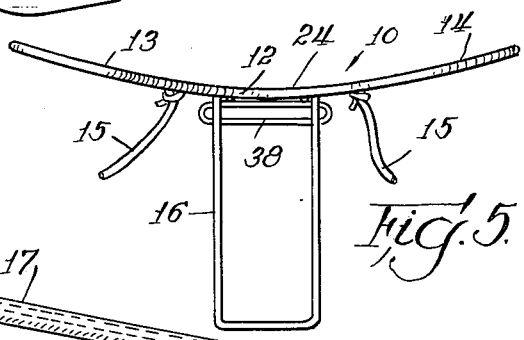
FIG. 5 is a front elevational view of the aid of FIG. 1.
Figure 3:
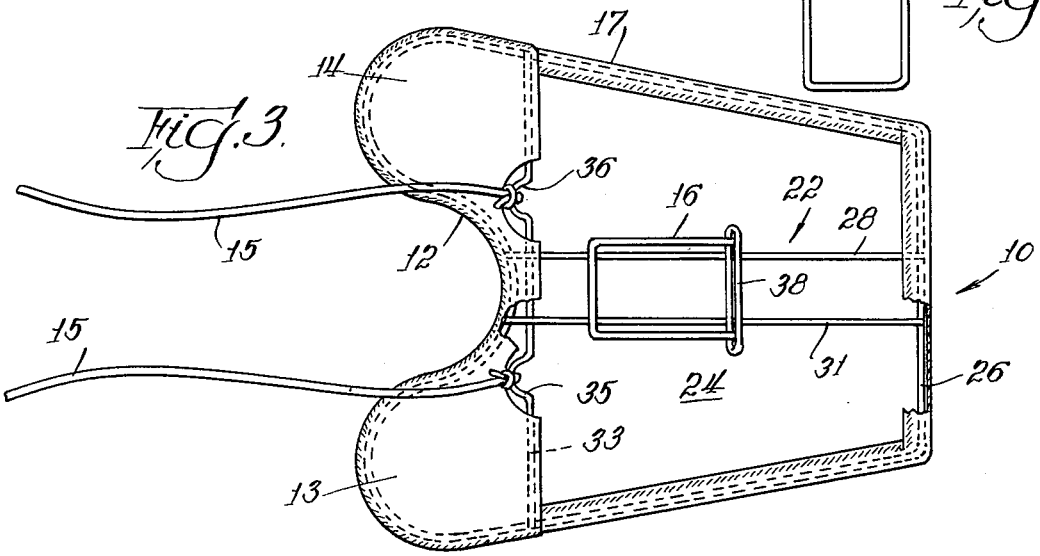
FIG. 3 is a bottom plan view, partially broken away, of the aid of FIG. 1.
Figure 4:
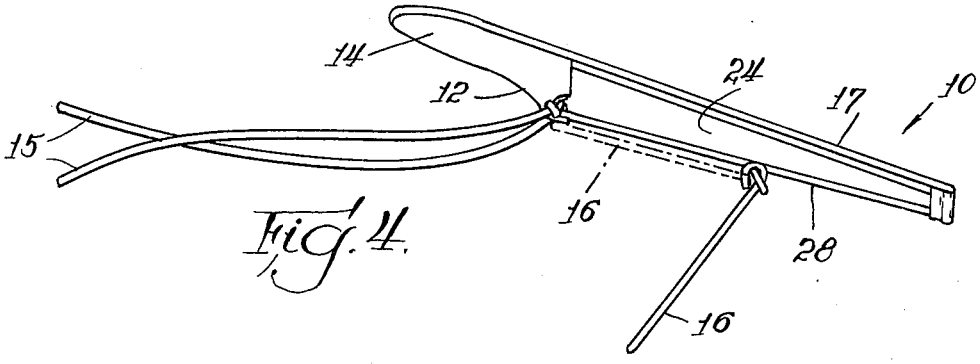
FIG. 4 is a side elevational view of the aid of FIG. 1.

The body portion 17, as best seen in FIG. 2, is tapered from front to rear, and the side contour as best seen in FIG. 4 is also slightly tapered from front to rear. As best seen in FIG. 5 of the drawings, the rounded tab portions 13 and 14 are integral with the body portion 17 in a smooth continuous one-piece manner and the entire sheet 24 is dish-shaped and bowed about its axial mid plane to serve the purpose of guiding the rinse water therealong.

Longitudinal or axial wires 28 and 31 are fixed at their opposite ends to the peripheral portion 26 at the cut-out portion 12 and the rear portion of the longitudinal wire portion 26. The wires 28 and 31 extend along the lowermost bottom portion of the trough-like body of the aid 10 for support purposes. A cross wire 33 having a pair of spaced-apart bent portions 35 and 36 extend transversely across the longitudinal wires 28 and 31 with the opposite ends of the cross wire 33 being fixed to the peripheral wire portion 26 where the tab portions 13 and 14 are integrally connected to the body portion 17.

An elongated flat loop of wire 38 extends transversely across and is fixed to the pair of wires 28 and 31 to serve as a cross member which limits the movement of the brace 16. A pair of hook portions 41 and 43 integrally connected to the ends of the U-shaped brace 16 surround the depending lower portion of the flattened loop 38 to enable the brace 16 to swing between its use position as shown in solid lines in FIG. 4 and its storage position as indicated in broken lines in FIG. 4. The folded position is where the brace 16 is disposed adjacent the underside of the trough-like body portion 17. The use position is a position where the brace 16 depends from the underside of the body portion of the aid 10, whereby the upper portion of the brace 16 extends from approximately the central portion of the underside of the trough-like body portion 17 at an angle less than 90 degrees downwardly to engage the back of the wearer. The loop 38 extends transversely beyond the pair of longitudinal wires 28 and 31 so that the hook portions 41 and 43 are hooked around the portion 38A of the loop 38 which is fixed to the wires 28 and 31 at the end portions of the loop 38 extending transversely beyond the wires 28 and 31. The lower portion 38B of the loop 38 depends from the body portion 17 to limit the backward swinging movement of the brace 16 to the use position as shown in solid lines in FIG. 4.

In order to secure the sheet 24 to the wire frame 22, a separate sheet 45 configured in the shape of the cut-out portion 22 and the rounded tab portions 13 and 14 and composed of the same material as the sheet 22 underlies the front portion of the aid 10 and is heat sealed along the line 47 to the sheet 24 at the peripheral edges of the sheet 45 and the front portion of the sheet 24 to form a pocket for receiving the front portion of the wire frame 22. The sheet 45 partially covers the cross wire 33, and the sheet 45 includes a pair of cut-out portions 49 and 50 for enabling the tie straps to be secured to the bend portions 35 and 36, respectively. The marginal edges of the sheet 24 are folded over the side and rear portions of the body portion 17 and heat sealed together to retain the peripheral wire portions 26 in place along the heat sealing lines 52.

While a particular embodiment of the present invention has been disclosed, it is to be understood that various different modifications are possible and are contemplated within the true spirit and scope of the appended claims. For example, various different colors and materials of the sheet 24 and the sheet 45 may be employed as would become apparent to those skilled in the art. There is no intention, therefore, of limitation to the exact abstract or disclosure herein presented.

What is claimed is:

1. An aid for facilitating the shampooing of hair, comprising:

frame means dish shaped about its axial mid plane;

an elongated sheet of filmy thin flexible light-weight water-resistant material attached to said frame means to form a trough-like guide;

a brace adapted to engage the back of the wearer for supporting the aid from below;

mounting means for connecting said brace to said frame at a central portion of the underside of said frame to extend downwardly and forwardly therefrom;

a pair of tie straps for securing the front portion of said aid to the neck of the wearer so that the aid can extend backwardly from and be supported entirely by the wearer;

means defining a U-shaped cut-out opening at the front portion of said frame for receiving and engaging the neck of the wearer; and a pair of upwardly sloping rounded tab portions on said frame at opposite sides of said cut-out opening for engaging the shoulder area of the wearer.

2. An aid according to claim 1, said mounting means for pivotally connecting said brace to said frame means to enable said brace to swing between a use position and a storage position.

3. An aid according to claim 2, further including retaining means for maintaining releasably said brace in its use position when the aid is attached to the wearer.

4. An aid according to claim 3, wherein said retaining means includes a cross member for limiting the backward movement of said brace.

5. An aid according to claim 4, wherein said cross member is in the form of a loop of rigid material fixed to said frame means, said brace including a U-shaped wire swingably connected at its hook ends to said loop.

6. An aid according to claim 1, wherein said tie straps are secured at one of their ends to said front portion of said aid.

7. An aid according to claim 1, wherein said sheet is dish shaped and bowed about its axial mid plane.

8. An aid according to claim 1, wherein said sheet is tapered axially from front to rear.

9. An aid according to claim 1, wherein said sheet is composed of plastic material, said plastic material being folded over peripheral portions of said frame means at the marginal edges of said sheet and heat sealed together to secure said sheet in place on said frame means, said frame means being composed of wire rods.

* * * * *